US010947871B2

(12) United States Patent
Pruett

(10) Patent No.: US 10,947,871 B2
(45) Date of Patent: Mar. 16, 2021

(54) ENGINE VALVE SPRING WITH DAMPING

(71) Applicant: Sven Walter Pruett, Lake Orion, MI (US)

(72) Inventor: Sven Walter Pruett, Lake Orion, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 16/808,563

(22) Filed: Mar. 4, 2020

(65) Prior Publication Data

US 2020/0284172 A1 Sep. 10, 2020

Related U.S. Application Data

(60) Provisional application No. 62/813,970, filed on Mar. 5, 2019.

(51) Int. Cl.
*F01L 1/46* (2006.01)

(52) U.S. Cl.
CPC ..... *F01L 1/462* (2013.01)

(58) Field of Classification Search
CPC ..... F01L 1/462
See application file for complete search history.

(56) References Cited

U.S. PATENT DOCUMENTS 5,246,215 A * 9/1993 Takamura ..... F01L 1/462 267/170
5,263,233 A * 11/1993 Kim ..... B05C 19/002 24/289
2008/0211156 A1* 9/2008 Check ..... F01L 1/462 267/170
2017/0097089 A1* 4/2017 Teknos ..... F16H 59/0208

* cited by examiner

*Primary Examiner* — Zelalem Eshete
(74) *Attorney, Agent, or Firm* — Ralph E Smith

(57) ABSTRACT

A valve spring for an engine valve of an internal combustion engine includes a body having a first end and an opposite second end and defining a plurality of coils having an outer surface, and a flocking material applied to at least a portion of the outer surface, the flocking material including a plurality of fibers configured to provide a passive vibro-acoustic damping to facilitate dynamic damping of the valve spring and reduce noise, vibration, and harshness.

11 Claims, 4 Drawing Sheets

ENGINE VALVE SPRING WITH DAMPING

CROSS REFERENCE TO RELATED APPLICATION

This application claims the benefit of U.S. Provisional Pat. App. No. 62/813,970, filed Mar. 5, 2019, the contents of which are incorporated herein by reference thereto.

FIELD

The present application relates generally to internal combustion engines and, more particularly, to a damping system for engine valve springs.

BACKGROUND

Engine valves are typically biased into a closed position by coil springs. During operation, the engine valves are repetitively opened and closed at high speeds, which can potentially result in noise, vibration, and harshness (NVH) produced by the coil springs. Conventional damping mechanisms to reduce NVH include expensive isolated valve covers, sound deadening pads, additional spring coils, flat damping spring elements, and friction spring jackets. That said, while such damping systems do work for their intended purpose, it is desirable to provide continuous improvement in the relevant art.

SUMMARY

In accordance with one example aspect of the invention, a valve spring for an engine valve of an internal combustion engine is provided. In an example implementation, the valve spring includes a body having a first end and an opposite second end and defining a plurality of coils having an outer surface, and a flocking material applied to at least a portion of the outer surface, the flocking material including a plurality of fibers configured to provide a passive vibro-acoustic damping to facilitate dynamic damping of the valve spring and reduce noise, vibration, and harshness.

In addition to the foregoing, the described valve spring may include one or more of the following features: wherein the flocking material is configured to absorb oil to further facilitate dynamic damping of the valve spring; wherein at least one of the first and second ends includes a flat end face; wherein the flat end face is coated with the flocking material; wherein the flat end face is uncoated; wherein the flocking material is configured to facilitate damping radiated, audible noise energy; and wherein the flocking material is configured to dampen radiated noise signature of the internal combustion engine and effect a dynamic stabilization mechanism to the valve spring to improve dynamic performance.

In accordance with another example aspect of the invention, a method of manufacturing a valve spring for an engine valve of an internal combustion engine is provided. The method includes, in one example implementation, applying an adhesive to an outer surface of the valve spring, and applying flocking material to at least a portion of the outer surface having the adhesive, the flocking material including a plurality of fibers configured to provide a passive vibro-acoustic damping to facilitate dynamic damping of the valve spring and reduce noise, vibration, and harshness.

In addition to the foregoing, the described method may include one or more of the following features: electrostatically attracting one end of fibers of the flocking material to the adhesive such that an opposite end of the fibers project away from the spring outer surface; curing a composition of the adhesive and flocking material to provide a textured surface; wherein the step of applying an adhesive further comprises applying the adhesive to a cleaned and electrically grounded outer surface of the spring; wherein the flocking material is a positively charged and micro-fibrous material; and wherein the flocking material is at least one of a solid or nano-tubular material.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

The present application is directed to systems and methods for coating an internal combustion engine valve spring to reduce noise, vibration, and harshness (NVH) and eliminate external NVH damping methods such as isolated valve covers, sound deadening pads, additional coils, etc. In the described examples, a flocking material is applied to the valve spring in a flocking operation to reduce NVH experienced while the internal combustion engine is operating.

Figure 1:
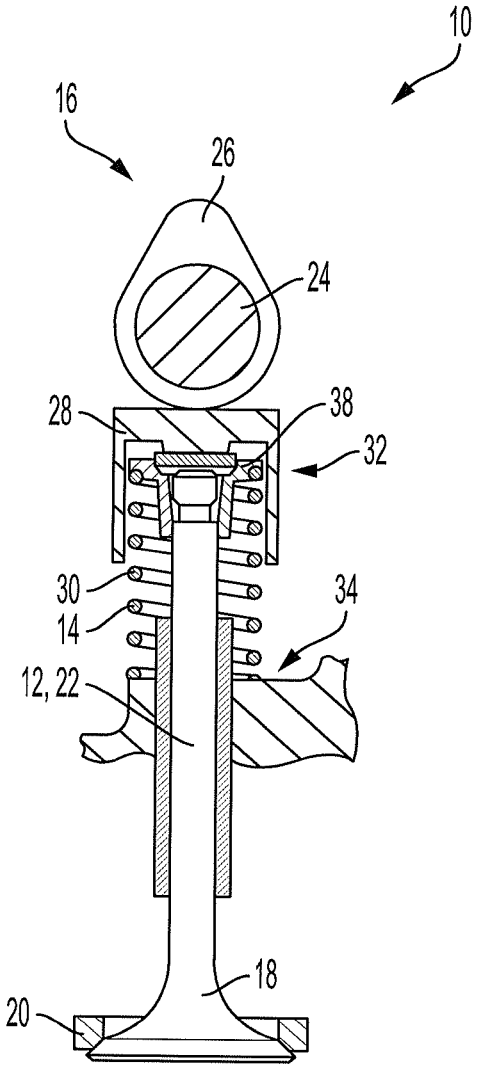
FIG. 1 is a sectional view of an example engine valve system in accordance with the principles of the present application.
Figure 3:
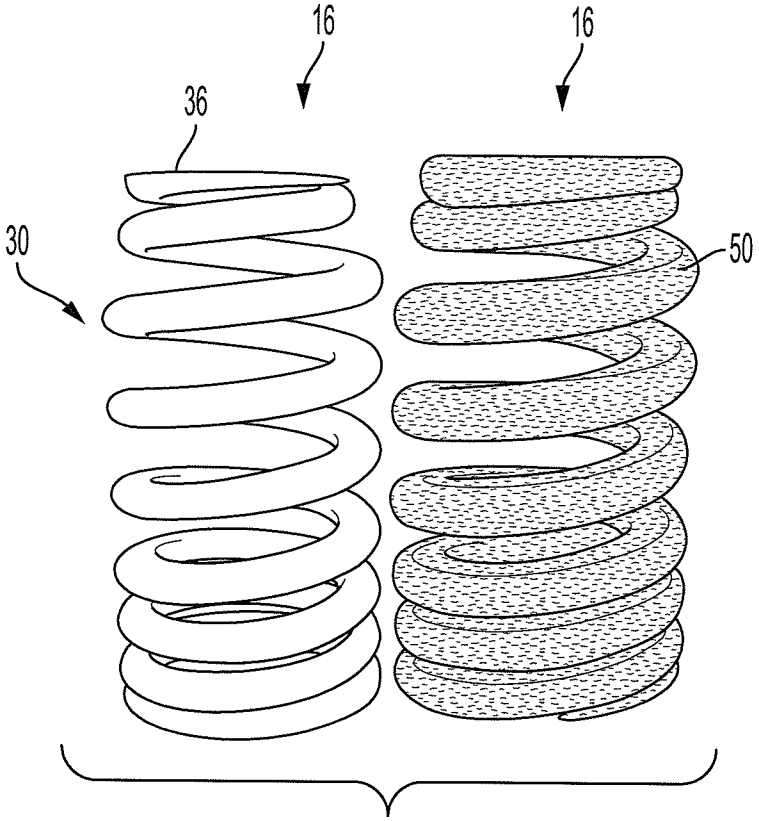
FIG. 3 is a side view of an example engine valve before a flocking operation (left) and after the flocking operation (right), in accordance with the principles of the present application.

With reference to FIG. 1, an example engine valve assembly is generally shown and indicated at reference numeral 10. In the example embodiment, the engine valve assembly 10 generally includes an engine valve 12, a valve spring 14, and a cam 16. The engine valve 12 includes a valve head 18 configured to seat against a valve seat insert 20 in a closed position (shown), and a valve stem 22 configured to extend through the valve spring 14. The cam 16 includes a cam shaft 24 and a cam lobe 26 configured to selectively engage a cam follower 28 that is operatively associated with the valve stem 22.

Figure 2:
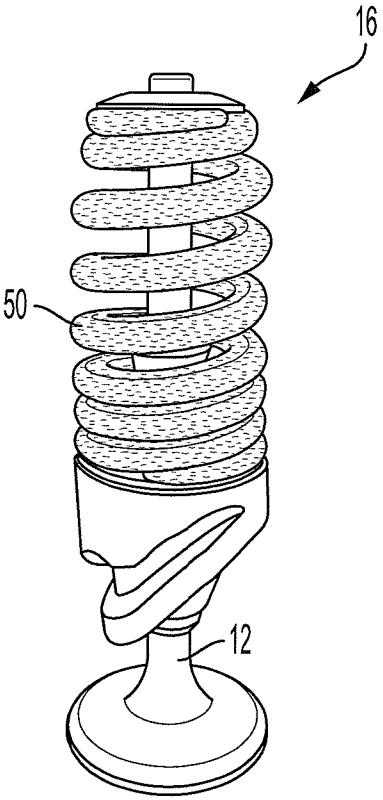
FIG. 2 is a perspective view of an example engine valve and flocked valve spring, in accordance with the principles of the present application.
Figure 5:
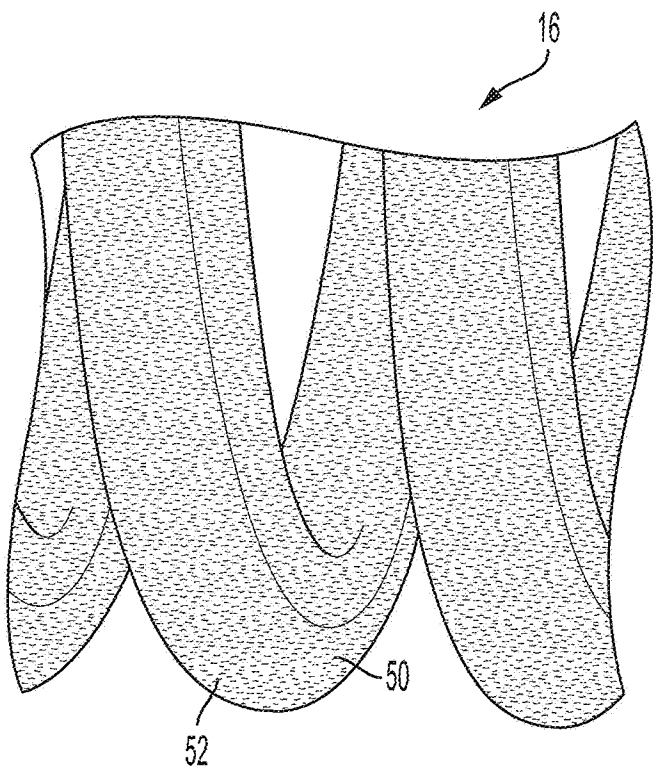
FIG. 5 is an enlarged perspective view of the example flocked valve spring shown in FIG. 4, in accordance with the principles of the present application.

In the example embodiment, the valve spring 16 includes a body having plurality of coils 30 extending between a first end 32 and an opposite second end 34. In one example, first and second ends 32, 34 include a flat end face 36 (e.g., see FIG. 4) to facilitate seating of the valve spring 16. The first end 32 is received within a retainer 38, and the second end 34 is received within a spring seat 40. As illustrated in FIG. 2, in some examples, the proximity of coils 30 becomes closer the nearer to the spring ends 32, 34.

As a conventional valve spring compresses, adjacent coils progressively come into contact with each other causing metal to metal contact at a very fast rate, which can cause the spring to 'clap' and produce noise, vibration, and/or harshness (NVH). As the coils stack up, they can potentially become ineffective in controlling valvetrain motion even though the rate is increasing the number of active coils capable of damping the dynamic nature of the valvetrain.

With additional reference to FIGS. 2-5, to reduce such NVH in the example embodiment, one or more spring coils 30 are coated with a flocking material 50, which includes a plurality of fibers 52 tightly packed and adhered to the surface of valve spring 16 in a generally or substantially perpendicular orientation thereto. Conventional flocking, such as described in U.S. Pat. No. 5,108,777, includes embedding of a short length of filament fiber (flock) in an adhesive layer covering a fabric substrate. A wide range of natural and synthetic fibers can be used as flock including rayon, cotton, nylon, polyester, and carbon fiber.

Flock is traditionally applied using three main methods: mechanical flocking, direct current electrostatic flocking, and alternating current electrostatic flocking. Mechanical flocking sifts the flock fibers down onto a coated substrate that is simultaneously subject to a vigorous beating on its underside, which causes the substrate to vibrate, orient vertically, and embed in the adhesive. AC and DC electrostatic flocking uses high voltages to generate an electrostatic field and positively charge the flock fibers, which are then driven into a grounded adhesive coating.

Figure 4:
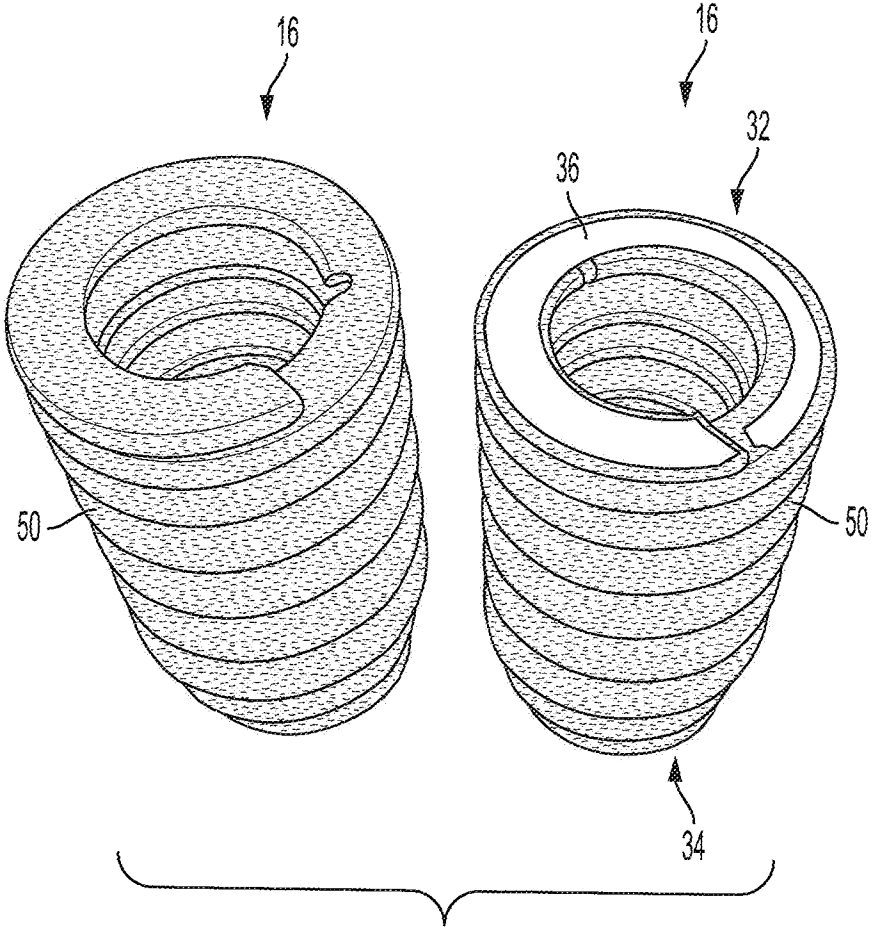
FIG. 4 is a perspective view of first and second example flocked valve springs, in accordance with the principles of the present application.

In the example embodiment, the flocking material 50 is applied to one or more surfaces of the spring 16 to thereby provide a cushion between adjacent contacting coils 30 as well as provide oil absorption capability to further facilitate dynamic damping of the spring 16. In some examples, such as shown in FIG. 4, the spring flat end face 36 is coated or left uncoated.

With the flocking material 50 applied to the spring outer surface, the spring 16 is capable of a passive vibro-acoustic damping operation to facilitate dampening radiated, audible noise energy as well as vibratory, inaudible spring energy to substantially reduce the radiated noise signature of the engine and effect a dynamic stabilization mechanism to the valve springs to improve overall dynamic performance. In one example, the flocking operation advantageously requires no change in the normal spring design or manufacturing process and can be selectively applied where dynamic spring performance or acoustic improvements are desired. It is contemplated that other coatings and methods of coating may be utilized on valve spring 16 to facilitate spring damping.

Figure 6:
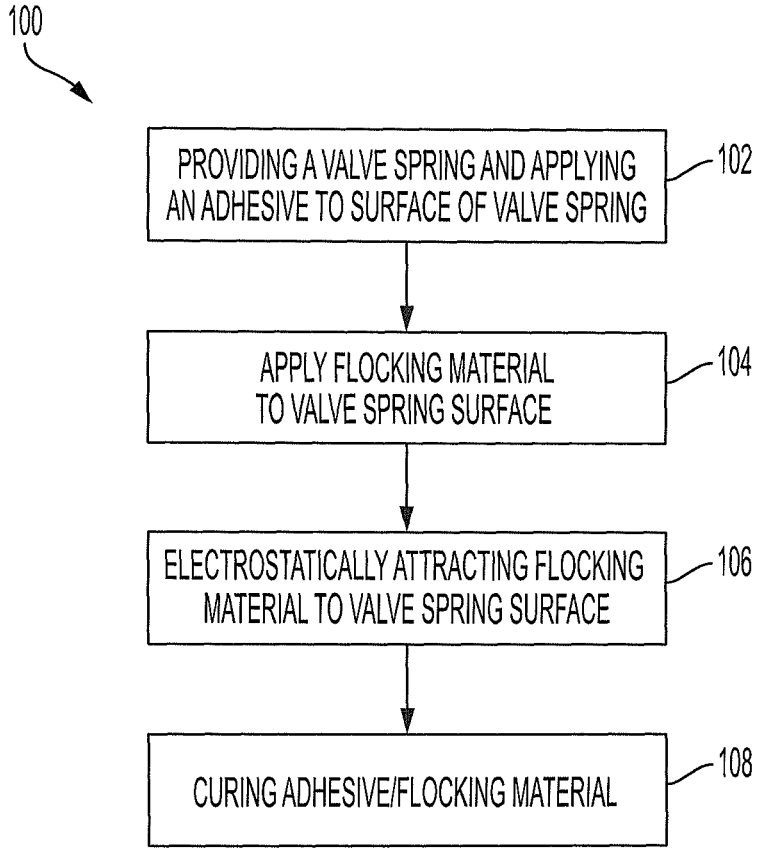
FIG. 6 is a flow diagram of an example method of manufacturing the flocked valve spring shown in FIG. 4, in accordance with the principles of the present application.

FIG. 6 illustrates an example method 100 of manufacturing valve spring 16. The method 100 begins at step 102 and includes providing valve spring 16 and applying an adhesive to a cleaned and electrically grounded surface of the spring 16. At step 104, positively charged, micro-fibrous, solid or nano-tubular material (e.g., "flocking") is sprayed onto the adhesive. At step 106, the micro-fibers are electrostatically attracted to the adhesive surface at one end, leaving the opposite "free" end projecting away from the spring surface. At step 108, following the adhesive/fiber matrix application, the composition is cured to form a durable, textured surface.

It will be appreciated that the specific fiber material, length, and thickness of the fibers, along with the adhesive characteristics can be varied to control the range and nature of the damping characteristics over a wide range. Moreover, in the example embodiment, the flocked surface retains significantly more oil on the surface of the spring, magnifying the natural dynamic damping characteristics of the oil. Additionally, the vibration damping characteristics of the protruding fibers works to substantially reduce the radiated noise by muting the coil clash and "ringing" that can naturally occur in conventional coiled valve springs during operation. In this way, the ordered fiber surface of flocking material 50 is configured to naturally dissipate vibration energy via the motion of the free end of the micro-fibers.

Described herein are systems and methods for coating an engine valve spring to reduce NVH and eliminate external NVH damping methods such as isolated valve covers, sound deadening pads, additional spring coils, flat damping spring elements, friction spring jackets, etc. In one example, a flocking is applied to the valve spring in a flocking operation. In some examples, the described coated valve spring reduces radiated mechanical noise from the engine by as much as 70% or more and incrementally improves dynamic valvetrain stability with no change to any other components. As such, the flocked valve spring utilizes retained oil as a fluid vibro-acoustic damper combined with natural damping characteristics of an ordered fiber surface to dissipate vibrational energy via the motion of the free end of the micro-fibers.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A valve spring for an engine valve of an internal combustion engine, the valve spring comprising:

a body having a first end and an opposite second end and defining a plurality of coils having an outer surface; and a flocking material applied to at least a portion of the outer surface, the flocking material including a plurality of fibers configured to provide a passive vibro-acoustic damping to facilitate dynamic damping of the valve spring and reduce noise, vibration, and harshness, wherein the flocking material is configured to absorb oil to further facilitate dynamic damping of the valve spring.

2. The valve spring of claim 1, wherein at least one of the first and second ends includes a flat end face.

3. The valve spring of claim 2, wherein the flat end face is coated with the flocking material.

4. The valve spring of claim 2, wherein the flat end face is uncoated.

5. The valve spring of claim 1, wherein the flocking material is configured to facilitate damping radiated, audible noise energy.

6. The valve spring of claim 5, wherein the flocking material is configured to dampen radiated noise signature of the internal combustion engine and effect a dynamic stabilization mechanism to the valve spring to improve dynamic performance.

7. A method of manufacturing a valve spring for an engine valve of an internal combustion engine, the method comprising:

applying an adhesive to an outer surface of the valve spring; and applying flocking material to at least a portion of the outer surface having the adhesive, the flocking material including a plurality of fibers configured to provide a passive vibro-acoustic damping to facilitate dynamic damping of the valve spring and reduce noise, vibration, and harshness, wherein the flocking material is a positively charged and micro-fibrous material.

8. The method of claim 7, further comprising electrostatically attracting one end of fibers of the flocking material to the adhesive such that an opposite end of the fibers project away from the spring outer surface.

9. The method of claim 7, further comprising curing a composition of the adhesive and flocking material to provide a textured surface.

10. The method of claim 7, wherein the step of applying an adhesive further comprises applying the adhesive to a cleaned and electrically grounded outer surface of the spring.

11. The method of claim 7, wherein the flocking material is at least one of a solid or nano-tubular material.

* * * * *